US011107415B2

(12) United States Patent
Meng

(10) Patent No.: US 11,107,415 B2
(45) Date of Patent: Aug. 31, 2021

(54) DISPLAY DRIVING METHOD AND DEVICE, COMPRESSION AND DECOMPRESSION METHODS AND DEVICES, DISPLAY DEVICE AND STORAGE MEDIUM

(71) Applicant: BOE Technology Group Co., Ltd., Beijing (CN)

(72) Inventor: Song Meng, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/634,785

(22) PCT Filed: Jun. 14, 2019

(86) PCT No.: PCT/CN2019/091315
§ 371 (c)(1),
(2) Date: Jan. 28, 2020

(87) PCT Pub. No.: WO2020/019902
PCT Pub. Date: Jan. 30, 2020

(65) Prior Publication Data

US 2021/0074222 A1 Mar. 11, 2021

(30) Foreign Application Priority Data

Jul. 27, 2018 (CN) ..... 201810847800.5

(51) Int. Cl.
*G09G 3/3275* (2016.01)

(52) U.S. Cl.
CPC ... *G09G 3/3275* (2013.01); *G09G 2300/0439* (2013.01)

(58) Field of Classification Search
CPC ..... G09G 3/3275
(Continued)

(56) References Cited

U.S. PATENT DOCUMENTS

2015/0187328 A1 7/2015 Kim et al.
2015/0279325 A1 10/2015 Lu et al.
(Continued)

FOREIGN PATENT DOCUMENTS

CN 103761933 A 4/2014
CN 104156182 A 11/2014
(Continued)

OTHER PUBLICATIONS

Apr. 26, 2020—(CN) First Office Action Appn 201810847800.5 with English Translation.
(Continued)

*Primary Examiner* — Long D Pham
(74) *Attorney, Agent, or Firm* — Banner & Witcoff, Ltd.

(57) ABSTRACT

A display driving method, compensation data compression and decompression methods and devices, a display device and a storage medium. The compensation data compression method includes dividing a display panel into at least one region; determining a reference value according to first compensation data of each pixel unit in each of at least one region; performing a computation on the first compensation data and the reference value to obtain corresponding second compensation data. The storage bit length of the second compensation data is shorter than the storage bit length of the first compensation data.

19 Claims, 6 Drawing Sheets

(58) Field of Classification Search
USPC ..... 345/204
See application file for complete search history.

(56) References Cited

U.S. PATENT DOCUMENTS

| | | | | |
|---|---|---|---|---|
| 2017/0116904 | A1* | 4/2017 | Jun | G09G 3/3677 |
| 2017/0323619 | A1* | 11/2017 | Lee | G09G 5/10 |
| 2018/0088885 | A1 | 3/2018 | Deng et al. | |
| 2018/0191371 | A1 | 7/2018 | Tao et al. | |
| 2018/0330682 | A1 | 11/2018 | Zhang | |
| 2019/0197935 | A1* | 6/2019 | Kim | G09G 3/006 |

FOREIGN PATENT DOCUMENTS

| | | | |
|---|---|---|---|
| CN | 104751794 | A | 7/2015 |
| CN | 104954797 | A | 9/2015 |
| CN | 105700847 | A | 6/2016 |
| CN | 106339196 | A | 1/2017 |
| CN | 106531045 | A | 3/2017 |
| CN | 106782300 | A | 5/2017 |
| CN | 106952627 | A | 7/2017 |
| CN | 106991959 | A | 7/2017 |
| CN | 107068050 | A | 8/2017 |
| CN | 107799065 | A | 3/2018 |
| JP | 2017227755 | A | 12/2017 |
| KR | 20180059158 | A | 6/2018 |

OTHER PUBLICATIONS

Dec. 24, 2020—(CN) Second Office Action Appn 201810847800.5 with English Translation.

* cited by examiner

| | | | |
|---|---|---|---|
| 1 | 2 | 3 | 4 |
| 5 | 6 | 7 | 8 |
| 9 | 10 | 11 | 12 |

| | | | |
|---|---|---|---|
| 1 | 2 | 3 | 4 |
| 5 | | 6 | 7 |
| 8 | 9 | 10 | 11 |

DISPLAY DRIVING METHOD AND DEVICE, COMPRESSION AND DECOMPRESSION METHODS AND DEVICES, DISPLAY DEVICE AND STORAGE MEDIUM

CROSS-REFERENCE TO RELATED APPLICATION

The application is a U.S. National Phase Entry of International Application No. PCT/CN2019/091315 filed on Jun. 14, 2019, designating the United States of America and claiming priority to Chinese Patent Application No. 201810847800.5 filed on Jul. 27, 2018. The present application claims priority to and the benefit of the above-identified applications and the above-identified applications are incorporated by reference herein in their entirety.

TECHNICAL FIELD

Embodiments of the present disclosure relate to a display driving method, compensation data compression and decompression methods and a compensation data compression device, a compensation data processing device and a display driving device of a display panel, a display device, and a storage medium.

BACKGROUND

An uneven display phenomenon occurs during the manufacturing process and a using process of organic light emitting diode (OLED) display panels. With the increase in the display size of the display panel, this uneven phenomenon becomes more prominent and finally results in poor display uniformity. To solve this problem, it is necessary to apply compensation to pixel units in the display panel to improve display uniformity. As the size of the display panel increases, a difference between the compensation data of pixel units in two regions which are far away from each other becomes larger. In general, each pixel unit has its corresponding compensation data. Thus, a large storage space and high read/write speed of the memory are required to realize effective compensation under a condition of displaying in high refresh rate. However, this will lead to increased hardware design difficulty and costs.

SUMMARY

At least one embodiment of the present disclosure discloses a compensation data compression method of a display panel. The method comprises dividing the display panel into at least one region; determining a reference value according to first compensation data of each pixel unit in each of the at least one region; performing a computation on the first compensation data and the reference value to obtain corresponding second compensation data, wherein a storage bit length of a second compensation data is shorter than a storage bit length of the first compensation data.

For example, in the compensation data compression method according to an embodiment of the present disclosure, the first compensation data comprises electrical compensation data or optical compensation data of each pixel unit.

For example, in the compensation data compression method according to an embodiment of the present disclosure, the determining the reference value according to the first compensation data of each pixel unit comprises: obtaining any one of a maximum value, a minimum value, an average value, a maximum integer not greater than the average value, a median value, and a maximum integer not greater than the median value of all values of the first compensation data of all pixel units in each of the at least one region, as the reference value.

For example, in the compensation data compression method according to an embodiment of the present disclosure, the performing the computation on the first compensation data and the reference value to obtain the corresponding second compensation data comprises: subtracting the reference value from the first compensation data respectively to obtain the corresponding second compensation data.

For example, in the compensation data compression method according to an embodiment of the present disclosure, for each of the at least one region, the first compensation data are presented in a matrix form. A position of each element in a matrix of the first compensation data is in one-to-one correspondence to a position of each pixel unit in the region.

For example, subsequent to obtaining the corresponding second compensation data, the compensation data compression method according to an embodiment of the present disclosure further comprises storing the reference value and the second compensation data.

For example, in the compensation data compression method according to an embodiment of the present disclosure, the dividing the display panel into the at least one region comprises dividing the display panel into a plurality of regions. The plurality of regions are arranged in rows and columns in the display panel.

For example, in the compensation data compression method according to an embodiment of the present disclosure, the dividing the display panel into the at least one region comprises: obtaining reference values of two adjacent regions respectively, subsequent to dividing the display panel into the plurality of regions; and merging the two adjacent regions into one region, in a case where a difference value between the two reference values is within a preset threshold range.

At least one embodiment of the present disclosure discloses a compensation data decompression method of a display panel. The display panel is divided into at least one region. Each region comprises a plurality of pixel units. For each of the plurality of pixel units, the method comprises: obtaining initial compensation data of the pixel unit, wherein the initial compensation data comprises a reference value corresponding to a region where the pixel unit is located and second compensation data corresponding to the pixel unit; performing a computation on the reference value and the second compensation data to obtain first compensation data corresponding to the pixel unit, wherein a storage bit length of the second compensation data is shorter than a storage bit length of the first compensation data; using the first compensation data as decompressed compensation data of the pixel unit.

For example, in the compensation data decompression method of the display panel according to an embodiment of the present disclosure, the method is sequentially performed for each of the at least one region.

At least one embodiment of the present disclosure discloses a display driving method of a display panel. The display panel is divided into at least one region. Each region includes a plurality of pixel units. For each of the plurality of pixel units, the method comprises: obtaining display data of the pixel unit; obtaining decompressed compensation data of the pixel unit; compensating for the display data by using the decompressed compensation data; using the compensated display data for display, wherein the obtaining the decompressed compensation data of the pixel unit comprises: obtaining initial compensation data of the pixel unit, wherein the initial compensation data comprises reference value corresponding to a region where the pixel unit is located and second compensation data corresponding to the pixel unit; performing a computation on the reference value and the second compensation data to obtain first compensation data corresponding to the pixel unit, wherein a storage bit length of the second compensation data is shorter than a storage bit length of the first compensation data; and using the first compensation data as the decompressed compensation data of the pixel unit.

For example, in the display driving method according to an embodiment of the present disclosure, the method is sequentially performed for each of the at least one region.

At least one embodiment of the present disclosure discloses a compensation data compression device of a display panel, comprising: a dividing module, configured to divide the display panel into at least one region; a determination module, configured to determine a reference value according to first compensation data of each pixel unit in each of the at least one region; a computation module, configured to perform a computation on the first compensation data and the reference value to obtain second compensation data, wherein the storage bit length of the second compensation data is shorter than the storage bit length of the first compensation data.

At least one embodiment of the present disclosure discloses a compensation data processing device of a display panel, comprising: a processor; a memory storing computer-executable instructions, wherein when the computer-executable instructions are executed by the processor, the above-mentioned compensation data compression method of the display panel is performed, or the above-mentioned compensation data decompression method of the display panel is performed.

At least one embodiment of the present disclosure discloses a display driving device of a display panel, comprising: a processor; a memory storing computer-executable instructions, wherein when the computer-executable instructions are executed by the processor, the above-mentioned display driving method of the display panel is performed.

At least one embodiment of the present disclosure discloses a display device, which comprises a display panel, and the above-mentioned display driving device of the display panel.

At least one embodiment of the present disclosure discloses a storage medium configured to store computer-executable instructions, wherein when the computer-executable instructions are executed by a computer, the above-mentioned compensation data compression method of the display panel is performed, or the above-mentioned compensation data decompression method of the display panel is performed, or the above-mentioned display driving method of the display panel is performed.

BRIEF DESCRIPTION OF THE DRAWINGS

In order to more clearly illustrate the technical solution of the embodiments of the present disclosure, the drawings of the embodiments will be briefly described in the following; it is obvious that the described drawings are only related to some embodiments of the present disclosure and thus are not limitative to the present disclosure.

DETAILED DESCRIPTION

In order to make objects, technical schemes and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "a first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1:
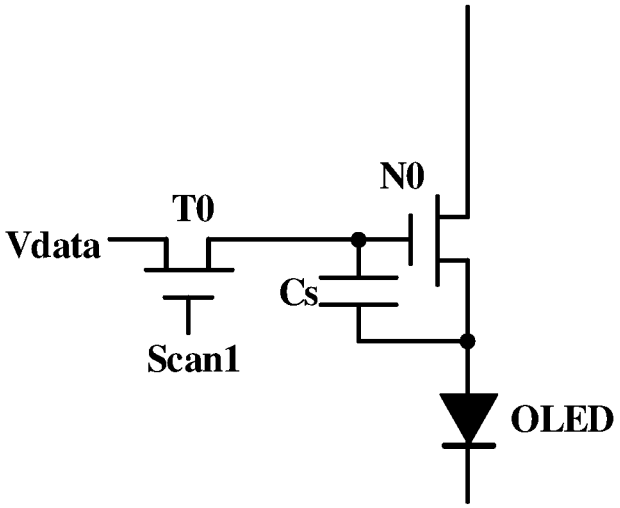
FIG. 1 is a schematic diagram of a 2T1C pixel circuit.

An OLED display panel adopts different types of thin film transistors (Thin Film Transistor, TFT) to form pixel circuits. The process stability of the thin film transistors is a main factor affecting the display effect. For example, a schematic diagram of a 2T1C pixel circuit for an OLED display panel is shown in FIG. 1. The circuit includes a switching transistor T0, a driving transistor N0, and a storage capacitor Cs. The switching transistor T0 is turned on/off by a scanning signal, and thereby the storage capacitor Cs is charged by a voltage corresponding to display data. Thus, a conduction degree of the driving transistor N0 is controlled through a data voltage stored in the storage capacitor Cs. Thereby, a current flowing across the OLED is controlled and luminous brightness of the OLED is adjusted.

Due to the difference in threshold voltages and mobilities of driving transistors of a plurality of pixel units, there is a uniformity or stability deviation problem in both low-temperature polysilicon thin film transistors and oxide thin film transistors. This problem may lead to different currents supplied to individual pixel units, which may cause brightness deviation, decrease brightness uniformity of a display panel, and even produce regional spots or patterns. This phenomenon may be perceived by human eyes (i.e., Mura (Mura) phenomenon). This phenomenon is especially prominent for larger size display panels. Moreover, the brightness of an OLED display panel itself may be gradually decreased as the increase of lighting time. These problems are difficult to be completely overcome through manufacturing processes. Thus, various compensation technologies are needed to solve these problems. Therefore, it is required to make brightness of pixel units to reach ideal values through compensation technologies.

Compensation methods for pixel units may include internal compensation and external compensation. Internal compensation technology refers to a method that performs compensation using compensation sub-circuits formed by thin film transistors within pixels. In general, internal compensation cannot satisfy all the brightness compensation requirements of display panels, and thus external compensation is usually required to improve the compensation effect. External compensation technology refers to a method that senses the electrical or optical characteristics of a pixel through an external drive circuit or device and then performs compensation. According to different data acquisition methods, external compensation could include electrical compensation and optical compensation.

Currently, as sizes of display panels are increasing, compensation parameters of pixel units in different regions in a display panel are significantly different. Compensation data require a larger storage bit length to store, which makes the amount of compensation data larger. A larger storage space is required, and higher requirements on the reading performance of a storage device of the display panel are proposed. In order to reduce manufacturing costs, compensation data require being compressed to reduce the storage space. A compensation data compression algorithm for a display panel, which uniformly compresses the compensation data of each pixel unit of an entire display panel, has a low data compression ratio. Or the accuracy of compensation data is reduced, that is to say, a lossy compression on compensation data is performed.

At least one embodiment of the present disclosure provides a compensation data compression method of a display panel. The method comprises: dividing the display panel into at least one region; determining a reference value according to first compensation data of each pixel unit in each of the at least one region; performing a computation on the first compensation data and the reference value to obtain corresponding second compensation data. A storage bit length of the second compensation data is shorter than a storage bit length of the first compensation data.

Correspondingly, at least an embodiment of the present disclosure also provides a compensation data compressing device of a display panel, a compensation data decompression method of a display panel, a compensation data processing device of a display panel, a display driving method and device, a display device, and a storage medium.

The method and the device provided by the embodiments of the present disclosure can realize effective lossless compression and decompression on the display compensation data, and reduce the manufacturing costs of a display panel while optimizing the display effect.

Embodiments of the present disclosure will be described in detail below combined with the accompanying drawings.

Figure 2A:
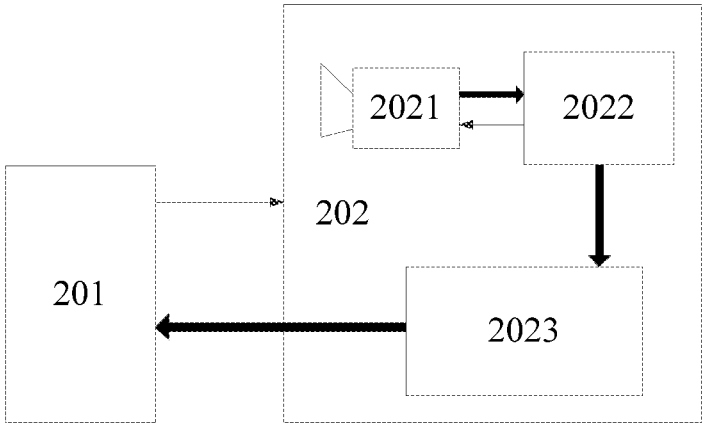
FIG. 2A is a schematic diagram of an external optical compensation system according to an embodiment of the present disclosure.

At least an embodiment of the present disclosure provides a schematic diagram of an optical compensation system as shown in FIG. 2A. The optical compensation system includes a display panel 201 to be detected and an optical compensation device 202. The optical compensation device 202 includes a camera 2021, a data processing unit 2022, a control unit 2023, etc., which are in signal connection with each other in a wired or wireless manner. The data processing unit 2022 of the optical compensation device 202 sends a test image to the control unit 2023. The control unit 2023 processes the test image and then sends the processed test image to the OLED display panel 201 to be test, in order to display a required image for testing. Besides, the data processing unit 2022 further obtains a captured image of an actual displayed image of the OLED display panel from the camera 2021, compares the captured image with the test image to obtain compensation data of pixel units, and inputs the compensation data into a storage device of the OLED display panel 201 for storage, which are used for compensation in the subsequent display operation process of the display panel. Upon being stored, the optical compensation data usually remain unchanged over time.

Figure 2B:
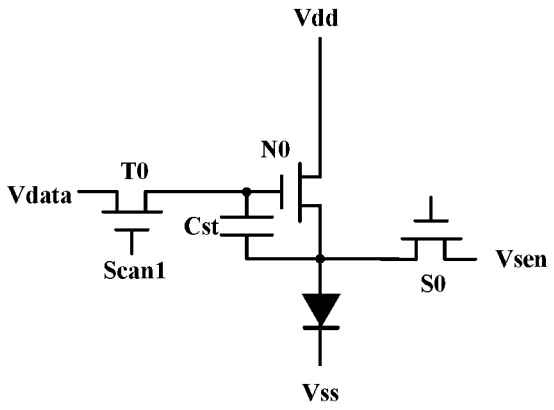
FIG. 2B is a schematic diagram of an electrical compensation pixel circuit according to an embodiment of the present disclosure.

FIG. 2B is a schematic diagram of an electrical compensation pixel circuit according to an embodiment of the present disclosure. The pixel circuit is a 3T1C circuit used for each pixel unit of the display panel, and has a function of detecting the threshold voltage of a driving transistor. To realize the compensation function, a sensing transistor S0 may be introduced on a basis of a pixel circuit (2T1C circuit) including a switching transistor T0, a driving transistor N0, and a storage capacitor Cst. That is to say, a first end of the sensing transistor S0 may be connected to a source of the driving transistor N0, and a second end of the sensing transistor S0 may be connected to a detection circuit (not shown) via a sensing line. Here, the driving transistor N0 is an N-type transistor, one end of which is connected to a first voltage terminal Vdd (e.g., a high voltage terminal). The cathode of an organic light emitting diode is connected to a second voltage terminal Vss (e.g., a low voltage terminal). A first end (e.g., drain) of the switching transistor T0 is connected to a data line Vdata, a gate of the switching transistor T0 is connected to a scan line Scan1, and a second end of the switching transistor T0 is connected to a gate of the driving transistor N0. Thus, when a data voltage is written to the gate of the driving transistor N0 and the data voltage is stored by the storage capacitor Cst, the driving transistor N0 becomes conductive, and then a detection circuit Vsen is discharged via the sensing transistor S0 so that the level of the source of the driving transistor N0 changes. When a voltage Vs at the source of the driving transistor N0 is equal to the difference between a gate voltage Vg of the driving transistor N0 and a threshold voltage Vth of the driving transistor, the driving transistor N0 is turned off. In this case, after the driving transistor N0 is turned off, the sensing voltage (that is, a voltage Vb of the source after the driving transistor N0 is turned off) can be obtained from the source of the driving transistor N0 via the turned-on sensing transistor S0. After obtaining the voltage Vb of the source of the driving transistor N0 after the driving transistor N0 is turned off, the threshold voltage Vth of the driving transistor can be obtained, Vth=Vdata−Vb. Thus, the electrical compensation data is established for each pixel circuit based on the threshold voltage of the driving transistor in each pixel circuit, and a threshold voltage compensation function for each sub-pixel of the display panel is further realized. For example, while working, the display panel can perform real-time electrical compensation detection to obtain updated electrical compensation data, that is, the electrical compensation data change over time.

Figure 3:
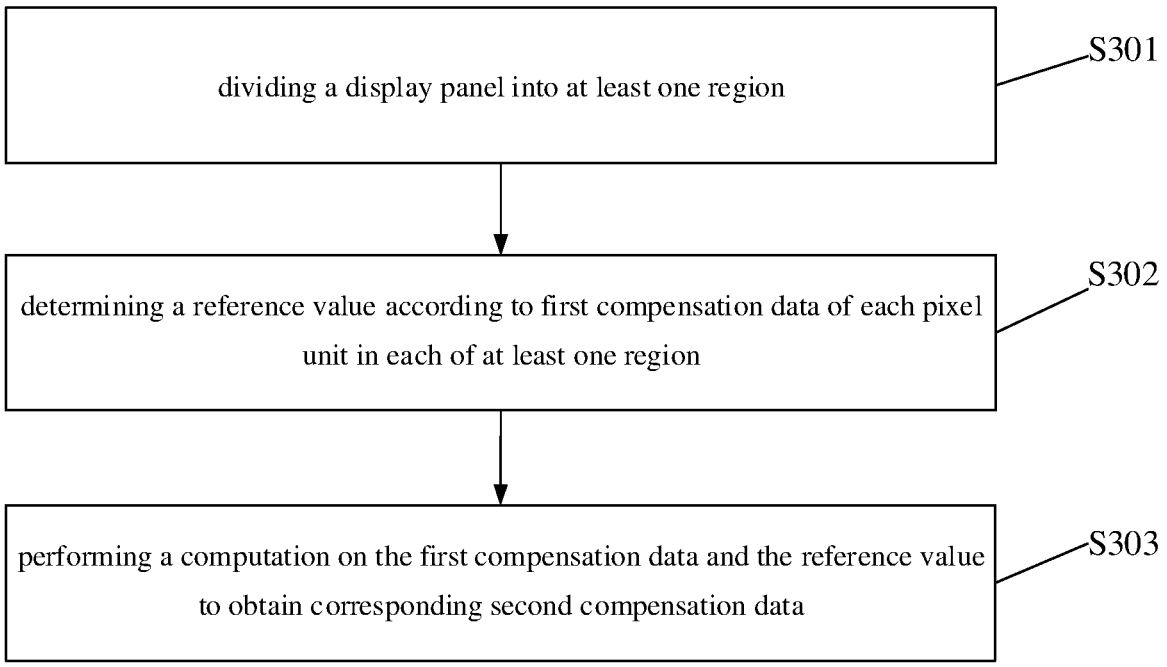
FIG. 3 is a schematic diagram of a compensation data compression method of a display panel according to an embodiment of the present disclosure.

At least an embodiment of the present disclosure provides a compensation data compression method of a display panel. For example, the method is adaptable for an optical compensation system as shown in FIG. 2A to obtain optical compensation data, and may also be adaptable for electrical compensation pixel circuits as shown in FIG. 2B to obtain electrical compensation data. But implementations of the present disclosure are not limited to a specific method for obtaining optical compensation data or electrical compensation data. The flow chart of the compensation data compression method is shown in FIG. 3, and the method includes the following steps S301 to S303:

Step S301, dividing a display panel into at least one region.

Step S302, determining a reference value according to first compensation data of each pixel unit in each of at least one region.

Step S303, performing a computation on the first compensation data and the reference value to obtain corresponding second compensation data.

For example, in embodiments of present disclosure, in order to achieve a higher compression ratio for data compression on a premise of lossless compression, the display panel can be divided into regions to obtain at least one region (for example, a plurality of regions), and corresponding compensation data can be obtained for each region respectively. Please note that the compensation data before being compressed or after being decompressed are referred to as "a first compensation data" and the compensation data after being compressed are referred to as "second compensation data" accordingly.

Due to the display nonuniformity of the display panel, the first compensation data of the pixel units in different regions are different. So in each divided region, a reference value corresponding to the region is determined according to the first compensation data of each pixel unit in the region. The reference value is a common value of the compensation data in the region, and the reference value is used for performing a computation on a compensation data of each pixel unit in the compensation data compression method.

As described above, the first compensation data may be obtained by, for example, the optical compensation system shown in FIG. 2A, or may be obtained by testing the display panel using other devices and methods. After the reference value is obtained, a computation may be performed on the first compensation data in each region and the reference value to obtain the second compensation data. The storage bit length of the second compensation data is shorter than the storage bit length of the first compensation data. Since the storage bit length of the second compensation data is shorter than the storage bit length of the first compensation data, data compression can be realized. For example, the first compensation data may be an optical compensation data or an electrical compensation data corresponding to each pixel unit of the display panel. The type of the compensation data depends on specific circumstances and is not specifically limited in the embodiments of the present disclosure. For example, the first compensation data may be obtained through measurement and calculation before the compensation operation of the display panel, or may be obtained through measurement and calculation after the display panel leaves the factory. For example, the first compensation data are stored in a memory of the display panel, from which the display panel can read the first compensation data when required.

For example, after the first compensation data of all pixel units in each region of the display panel are obtained, different types of statistical data can be obtained based on these first compensation data, and the reference value of the region can be selected/determined from these statistical data. For example, a maximum value of all the values of the first compensation data corresponding to the pixel units in the region may be selected, and a minimum value thereof may be selected, or a calculated average or median value may be selected. For example, for some cases where there is a remainder, in order to reduce the storage bit length of the compensation data, a maximum integer not greater than the average value, or a maximum integer not greater than the median value may also be selected as the reference value. Certainly, in some cases, the maximum integer not greater than the average value is equal to the average value, and the maximum integer not greater than the median value is equal to the median value. For example, when the first compensation data corresponding to individual pixel units in a region is relatively close to each other, selecting the maximum value, the minimum value, the average value or the median value for data compression may lead to a very similar effect, which may all achieve a purpose of reaching a higher data compression ratio. However, if a coverage range of all the first compensation data is large in a region, and if the maximum value or the minimum value is selected as the reference value, the data compression effect is slightly worse than that in the case where the average value is selected as the reference value. Alternatively, due to the mathematical characteristics of the median value, it is not sensitive to the maximum value and the minimum value of the first compensation data, and the median value can also be selected as the reference value corresponding to the first compensation data in the region, thus obtaining a better data compression effect.

For example, after determining a reasonable reference value, in order to obtain second compensation data based on the first compensation data, the corresponding reference value may be subtracted from the first compensation data in each divided region. For example, in a region of a display panel, the first compensation data of each pixel unit of six-pixel units are 121, 123, 124, 125, 127, 129, respectively. For example, if the minimum value 121 is selected as the reference value, the second compensation data are 0, 2, 3, 4, 6 and 8 respectively. Here, since the first compensation data are all three-digit numbers and the second compensation data are all one-digit numbers, the storage bit length of the second compensation data is shorter than the storage bit length of the first compensation data. Therefore, although a storage space for the reference value is increased, a storage space required for compensation data of all pixel units in the region is significantly reduced, thus a storage space required for compensation data in the region as a whole is significantly reduced. Moreover, as described below, the first compensation data can be accurately recovered by the reference value and the second compensation data, so that the above compensation data compression method realizes lossless compensation data compression.

For example, in order to simplify the calculation, since the pixel units of the display panel are arranged in an array, the set of the first compensation data corresponding to each pixel unit can also be presented in a matrix form. Moreover, in each region, a position of an element in a matrix of the first compensation data indicates a position of a pixel unit in the region corresponding to a compensation data.

For example, after being determined, the reference value of each region and the second compensation data of each pixel unit can be stored, for example, in the form of a look-up table, to facilitate being invoked when the display panel performs a display operation later. The method of the present embodiment can be used for different types of electronic devices, such as mobile phones, computers, etc. The reference value and the second compensation data corresponding to each region can be stored in a designated storage device, such as a ROM (Read Only Memory) of the mobile phone, a hard disk of the computer, etc. The physical location and type of the storage device are not specifically limited in the present embodiment.

Figures 4, 5, 6:
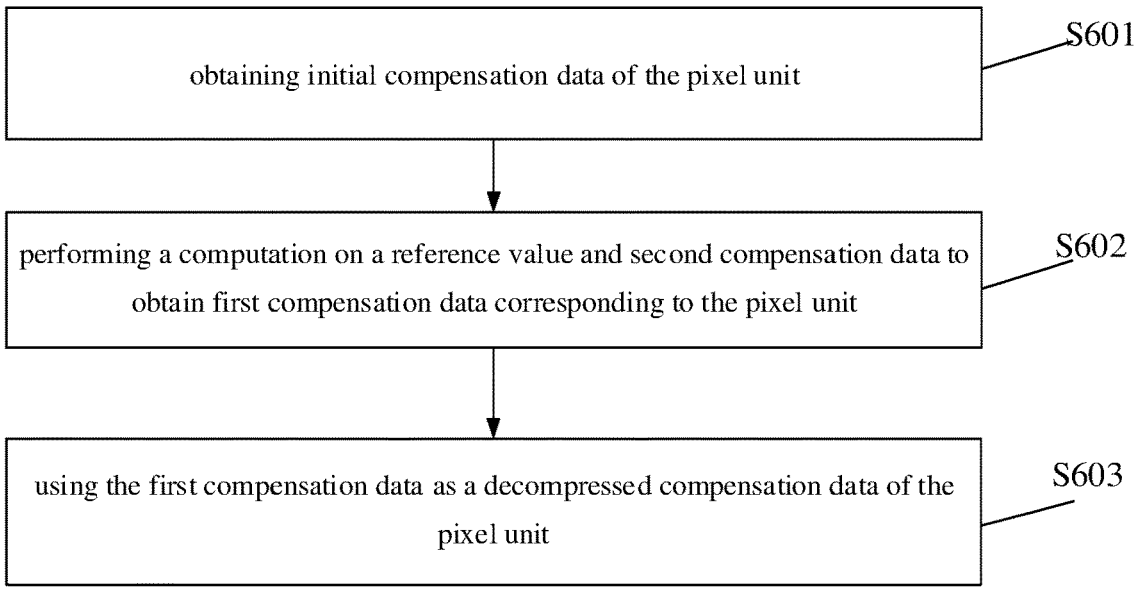
FIG. 4 is a schematic diagram of dividing a display panel into regions according to an embodiment of the present disclosure.
FIG. 5 is another schematic diagram of dividing a display panel into regions according to an embodiment of the present disclosure.
FIG. 6 is a flow chart of a compensation data decompression method of a display panel according to an embodiment of the present disclosure.

For example, when dividing the display panel into regions, the display panel may be regularly divided into more regions for the convenience of compressing data later. For example, these regions are arranged in a plurality of rows and columns on the display panel, for example, 3 rows and 4 columns, totally 12 regions. The schematic diagram of dividing the display panel into regions is shown in FIG. 4, which divides the display panel into 12 regions. These regions can be evenly distributed, or the display panel can be partitioned correspondingly according to the distribution of the first compensation data stored in advance, which is not limited to the present embodiment.

For example, when dividing the display panel into regions, in order to reduce a calculation amount of data compression, a merging operation for the regions may be performed after a preliminary division (for example, the above-mentioned multi-row and multi-column division method) to reduce the number of regions. The implementation of the present disclosure is not limited to a specific method of merging regions. For example, two adjacent regions are randomly selected and their reference values are respectively determined. If the difference value between the two reference values is within a preset threshold range, the first compensation data of the two regions are relatively close to each other, and the two regions may be merged into one region.

After the two adjacent regions are merged, the merged region may also be compared with other adjacent regions in term of reference value. If the condition is met, merging can be continued, thereby further reducing the number of regions and correspondingly further reducing the calculation amount of data compression and further reducing the storage space required for compressed compensation data.

For example, according to the region division of FIG. 4, if the calculated difference value between the reference values of region 6 and region 7 is within the threshold range, region 6 and region 7 can be merged and the dividing of regions is re-performed. FIG. 5 is a schematic diagram of the display panel region division after the merging of regions. After a new region 6 is obtained, the reference value of the region 6 can also be re-determined, and the reference value of the compensation data of an adjacent region such as region 5 can be obtained. If the difference value between the reference values of the two regions is within the preset threshold range, the merging of regions can be continued.

For example, a resolution of a display panel is 3840*2160, that is, there are 3840*2160 pixel units in the display panel. For example, after a standard test image is inputted, a compensated BMP displayed image can be obtained from the display panel, and a first compensation data of each pixel unit can be obtained based on the displayed image. Obtaining the first compensation data may be implemented in an optical compensation system such as that shown in FIG. 2A.

At first, the display image is divided into regions, and an even division method can be adopted. For example, in an example of the embodiments of the present disclosure, the BMP image is first divided into 9 regions, i.e., three rows and three columns. For example, one of the regions, such as the upper left corner region, is taken for data compression calculation. The first compensation data of a pixel unit in this region is stored using 8 bits (bit). The reference value is determined based on the first compensation data of the pixel units in the region. In this example, the minimum value is taken as the reference value, for example, the value is taken as 77. 77 is subtracted from the first compensation data of all pixel units in the region to obtain second compensation data. The first compensation data and the second compensation data are both presented in a matrix form. In the second compensation data, the maximum value is, for example, 28, which can be stored with a storage bit length of 5 bits. For example, in a case where the first compensation data changes over time (e.g., electrical compensation data), the corresponding second compensation data also changes over time. For example, the maximum value may require a storage bit length of 6 bits to store, so the second compensation data corresponding to each pixel may use a slightly larger storage bit length (such as 6 bits) to store the newly generated second compensation data. The reference value is still stored using 8 bits. Therefore, the data amount of the first compensation data for all pixel units in this region is 3840*2160*1/9*8 bit=7372800 bit. After determining the reference value of the region and performing calculations, the data amount of the second compensation data of all pixel units is: 3840*2160*1/9*6 bit+8 bit (for storing the reference value)=5529608. The two data amount are used to obtain the actual compression ratio (5529608/7372800) ≈75%. In the same way, the lossless compression can be continued on other divided regions.

For example, in another example of embodiments of the present disclosure, the above-mentioned BMP image can also be equally divided into 576 regions, that is, 24 rows and 24 columns. For example, the region in the upper left corner is taken for compensation data compression calculation. For example, the minimum value of all the first compensation data in the region is taken as a reference value (for example, 62). The first compensation data of a pixel unit in this region is stored using 8 bits. 62 is respectively subtracted from the first compensation data of all pixel units in the region to obtain the second compensation data. For example, in the case where the first compensation data are fixed over time (e.g., optical compensation data), the corresponding second compensation data do not change over time, and the maximum value in the second compensation data is, for example, 15, so the second compensation data of each pixel unit can be stored with fixed 4-bit storage bit length and without giving an additional 1 bit in advance considering the change amount as in the above example. The data amount of the first compensation data before data compression in this region is 3840*2160*1/576*8 bit=115200 bit. After the lossless compression of this region, the data amount of the second compensation data is 3840*2160*1/576*4 bit+8 bit (used for storing the reference value)=57608 bit. Therefore, the compression ratio of the region is calculated as (57608/115200)≈50%.

It should be noted that the more regions the display panel is divided into, the higher the similarity among the first compensation data corresponding to the pixel units in one region, and the smaller the storage bit length occupied by the obtained second compensation data. However, an increase in the number of divided regions will increase the number of reference values, which may conversely increase the storage space occupied by the compressed compensation data. Therefore, it is required to reasonably delimit the regions and find a balance between the number of storage bits of the second compensation data and the number of storage bits of the reference value to realize lossless compression of the compensation data with a higher compression ratio.

The compensation data compression method of the display panel provided by at least one embodiment of the present disclosure can effectively lossless-compress the compensation data of the display panel, thereby reducing the costs of the display panel.

Figure 8:
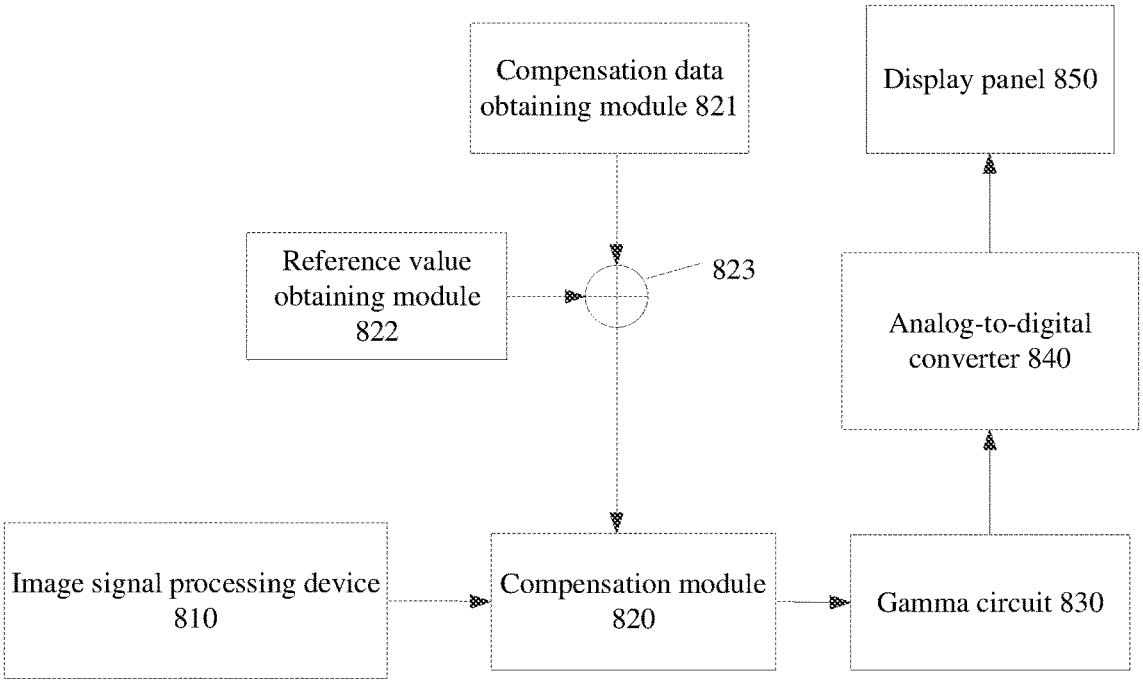
FIG. 8 is a schematic diagram of a display device according to an embodiment of the present disclosure.

Another embodiment of the present disclosure provides a compensation data decompression method of a display panel, which corresponds to the compensation data compression method of the display panel provided in the above embodiments and can be applied to a display device as shown in FIG. 8. The flowchart of the method is shown in FIG. 6. At first, the display panel is divided into at least one region. For each pixel unit in each region, the method includes the following steps S601 to S603.

Step S601, obtaining initial compensation data of the pixel unit.

Step S602, performing a computation on a reference value and second compensation data to obtain first compensation data corresponding to the pixel unit.

Step S603, using the first compensation data as a decompressed compensation data of the pixel unit.

For example, the initial compensation data is obtained by performing lossless-compression on the first compensation data of the display panel, and thus is obtained in a memory such as ROM. Moreover, the initial compensation data includes a reference value corresponding to the region where the pixel unit is located and second compensation data corresponding to each pixel unit, and accordingly the storage bit length of the second compensation data is shorter than the storage bit length of the first compensation data. The first compensation data corresponding to each pixel unit can be obtained by performing a computation on the reference value and the second compensation data of each pixel unit. The decompressed first compensation data is the same as the original first compensation data before compression. The above compression and decompression processes do not cause compression loss, that is to say, lossless compression and decompression are realized. After obtaining the first compensation data, the first compensation data can be used as decompressed compensation data of pixel units for subsequent compensation operations of display data.

For example, in a certain region of the display panel, the initial compensation data of each pixel unit is expressed as 125+{1, 3, 4, 2, 6, 7, 5}, where 125 is the reference value of the region and {1, 3, 4, 2, 6, 7, 5} are the second compensation data. After adding the reference value and the second compensation data respectively, the obtained first compensation data are {126, 128, 129, 127, 131, 132, 130}, which are used as decompressed compensation data for corresponding pixel units. Moreover, the decompression method would be executed in each divided region in order to ensure the accuracy of decompressing compensation data.

Figure 7:
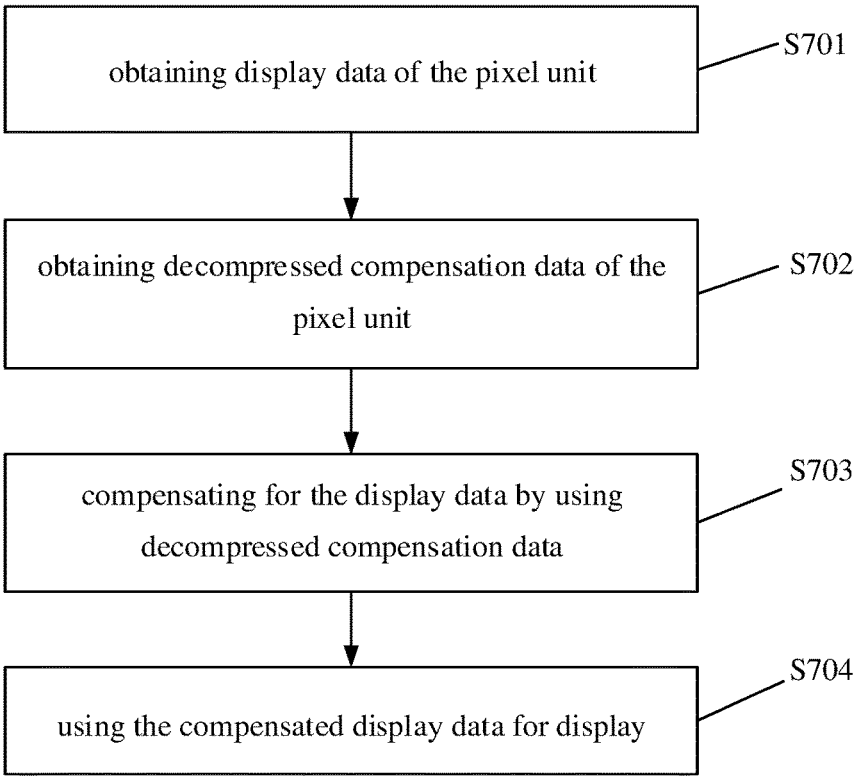
FIG. 7 is a flow chart of a display driving method of a display panel according to an embodiment of the present disclosure.

Accordingly, another embodiment of the present disclosure provides a display driving method of a display panel. The display panel is divided into at least one region. For each pixel unit in each region, the flowchart of the adopted display driving method is shown in FIG. 7, and includes the following steps S701 to S704.

S701, obtaining display data of the pixel unit.

S702, obtaining decompressed compensation data of the pixel unit.

S703, compensating for the display data by using decompressed compensation data.

S704, using the compensated display data for display.

For example, the display data of each pixel unit can be obtained by testing the display panel or reading pre-stored display data. The display data may be a display luminance value, a grayscale value, etc., or may be a value representing a display parameter of other physical meanings, and is not limited in this embodiment. After obtaining the display data, the decompressed compensation data of each pixel unit can be obtained according to the compensation data decompressing method in the above embodiment. Then, the decompressed compensation data is used to compensate for the display data and the compensated display data is used for display. Moreover, in order to ensure the display uniformity of the display panel after compensation, the display driving method of the present embodiment is performed sequentially for each divided region.

In the display driving method of the display panel, the method of obtaining the decompressed compensation data of the pixel unit is the compensation data decompression method described above, which will not be repeated here.

FIG. 8 is a schematic diagram of a display device according to an embodiment of the present disclosure, which adopts the display driving method in the above embodiments. The display device includes an image signal processing device 810, a compensation module 820, a gamma circuit 830, an analog-to-digital converter 840, and a display panel 850. For example, these modules may be implemented by hardware (e.g., circuit or FPGA, etc.) modules or software modules. For example, the compensation module 820, a compensation data obtaining module 821, and the reference value obtaining module 822 may be implemented as compensation circuits, compensation data obtaining circuits, and reference value obtaining circuits, respectively.

The image signal processing device 810 may receive an image signal, which is received by the display panel from an image source. The image signal is decoded by the image signal processing device 810 to obtain display data, and then the display data is transmitted to the compensation module 820. The image signal is received by the display panel through an antenna, various types of data interfaces (USB interface or HDMI interface) or a network interface, for example, and then demodulated by a modem, for example. For example, the decoded display data may be grayscale data, such as the initial pixel voltages before compensation.

For example, the compensation module 820 processes the received display data to obtain compensated display data. For example, the second compensation data of each pixel unit is obtained from a memory (not shown in FIG. 8) by the compensation data obtaining module 821, and the reference value is obtained from the memory (not shown in FIG. 8) by the reference value obtaining module 822. For example, before compensating for the display data in the compensation module 820, the second compensation data and the reference value are summed (or other required operations, such as multiplication, etc.) by a computation unit (computation circuit) 823 to obtain the first compensation data. Then, the compensation module 820 performs a computation on the display data from the image signal processing device 810 according to the first compensation data to obtain compensated display data. The obtained first compensation data may be optical compensation data or electrical compensation data. For example, the operation can be implemented by an adder (or multiplier) or software.

For example, the received display data is compensated for by the compensation module 820 to obtain a compensated pixel voltage (i.e., compensated display data). For example, the compensated pixel voltage is then transmitted to the gamma circuit 830.

The received compensated pixel voltage is adjusted by the gamma circuit 830, thereby the grayscale of the compensated display data (compensated pixel voltage) is corrected based on a predetermined gamma curve, i.e., gamma correction is performed. For example, the gamma-corrected display data are inputted to the analog-to-digital converter 840.

For example, the corrected display data are converted into analog signals by the analog-to-digital converter 840. And the converted analog signals are output to a data driving circuit under the control of a timing controller. The data driving circuit inputs the analog signals to pixel circuits (e.g., the pixel circuits shown in FIG. 1) of pixel units arranged in an array in the display panel 850 through data lines, thereby realizing corresponding display grayscales and corresponding display brightness. It should be noted that the pixel circuit is not limited to the pixel circuit shown in FIG. 1, but may also be pixel circuits of other structures, such as 4T2C or other pixel circuits with an internal compensation function.

Figure 9:
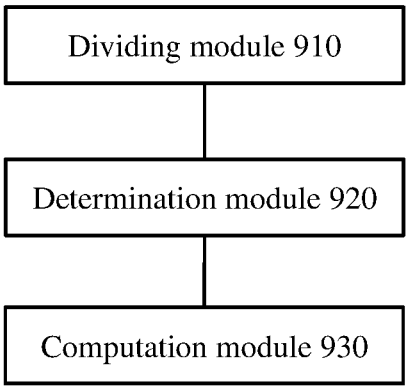
FIG. 9 is a schematic structural diagram of a compensating data compression device of a display panel according to an embodiment of the present disclosure.

Another embodiment of the present disclosure provides a compensation data compression device of a display panel. The structural diagram of the compensation data compression device in this embodiment is shown in FIG. 9. The compensation data compression device of a display panel includes a dividing module 910, which is configured for dividing a display panel into at least one region; a determination module 920 coupled to the obtaining module 910 and configured for determining a reference value according to a first compensation data of each pixel unit in each of the at least one region; and a computation module 930 coupled to the determination module 920 and configured for performing a computation on the first compensation data and the reference value to obtain second compensation data. The device realizes compression of compensation data, so the storage bit length of the second compensation data is shorter than the storage bit length of the first compensation data.

For example, step S301 may be implemented by the dividing module 910, and the dividing module 910 may be implemented by hardware, software, etc., for example, by a circuit or a computer program. For example, step S302 may be implemented by the determination module 920, which may be implemented by hardware, software, etc., for example, by a circuit or a computer program. For example, step S303 may be implemented by the computation module 930, which may be implemented by hardware, software, etc., for example, by a circuit or a computer program.

For example, the dividing module 910, the determination module 920, and the computation module 930 may be implemented as a dividing circuit, a determination circuit, and a computation circuit, respectively.

According to the compensation data compression device of the display panel provided by at least one embodiment of the present disclosure, the compensation data of the display panel can be losslessly compressed to reduce the data amount of the compensation data and further reduce the costs of the display panel.

It should be noted that the embodiments of the present disclosure may include more or fewer modules. The connection relationship between the modules is not limited and may be determined according to actual requirements. The specific configuration of each module is not limited and each module can be formed by analog devices, digital chips or other suitable methods according to the module principle.

Figure 10:
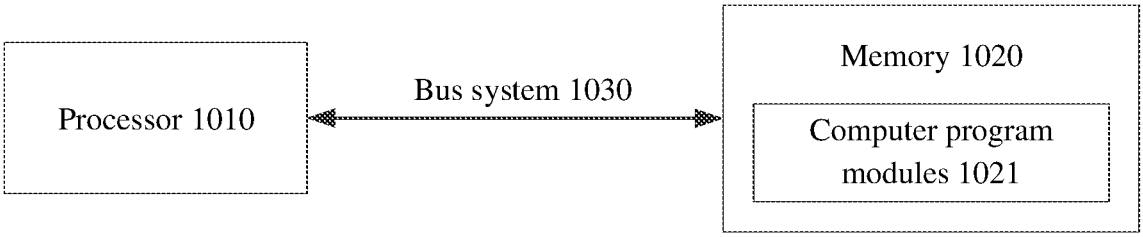
FIG. 10 is a schematic structural diagram of a compensating data compression device of a display panel according to another embodiment of the present disclosure.

Another embodiment of the present disclosure also provides a compensation data processing device of a display panel. The structural diagram of the device is shown in FIG. 10, which includes a processor 1010, a memory 1020, and a bus system 1030.

For example, the processor 1010 and the memory 1020 are connected through the bus system 1030. For example, one or more computer program modules 1021 may be stored in the memory 1020. For example, one or more computer program modules 1021 may include instructions for performing a compensation data compression method of a display panel provided by any embodiments of the present disclosure to realize lossless compression of compensation data of each pixel unit in the display panel. For example, the one or more computer program modules 1021 may further include instructions for performing a compensation data decompression method of a display panel provided by any embodiment of the present disclosure to decompress the compensation data and compensate for the display data with the decompressed data. For example, instructions in one or more computer program modules 1021 may be executed by the processor 1010.

For example, the bus system 1030 may be a common serial or parallel communication bus, and the embodiments of the present disclosure are not limited thereto.

For example, one or more computer program modules may be stored in a memory. For example, one or more computer program modules may include instructions for performing a compensation data decompression method of a display panel provided by any embodiment of the present disclosure, to decompress the compensation data of each pixel unit in the display panel. For example, instructions in one or more computer program modules may be executed by a processor.

Similarly, another embodiment of the present disclosure also provides a display driving device of a display panel. For example, the schematic structural diagram of the device is the same as the schematic structural diagram of a compensation data processing device of a display panel provided by an embodiment of the present disclosure, and includes a processor, a memory and a bus system.

For example, one or more computer program modules may be stored in a memory. For example, one or more computer program modules may include instructions for performing a display driving method of a display panel provided by any embodiment of the present disclosure, to realize the compensation of the display data with decompressed compensation data and to display images with the compensated display data. For example, instructions in one or more computer program modules may be executed by a processor.

In various embodiments of the present disclosure, any processor may be implemented by an application-specific integrated circuit chip, for example, the application-specific integrated circuit chip may be disposed on a motherboard. For example, a memory, a power supply circuit, and the like may also be disposed on the motherboard. The processor may also be implemented by a circuit or by software, hardware (circuitry), firmware, or any combination thereof. In embodiments of the present disclosure, the processor may include various computing structures, such as a complex instruction set computer (CISC) structure, a reduced instruction set computer (RISC) structure, or a structure that implements a combination of multiple instruction sets. In some embodiments, the processor may also be a microprocessor, such as an X86 processor or an ARM processor, or may be a digital processor (DSP) or the like.

In at least one embodiment of the present disclosure, for example, a memory may be provided on the motherboard, and the memory may store instructions capable of being executed by the processor and/or data. For example, the memory may include one or more computer program products, which may include various forms of computer-readable memory, such as a volatile memory and/or a nonvolatile memory. The volatile memory may include, for example, a random access memory (RAM) and/or a cache, etc. The nonvolatile memory may include, for example, a read-only memory (ROM), a hard disk, a flash memory, and the like. One or more computer program instructions may be stored on the computer-readable memory, and the processor may execute the program instructions to implement desired functions (implemented by the processor) of the embodiments of the present disclosure.

Another embodiment of the present disclosure also provides a display device, including a display driving device of a display panel provided by any embodiment of the present disclosure and a display panel, and the display operation can be performed using the display data compensated with the compensation data.

Figure 11:
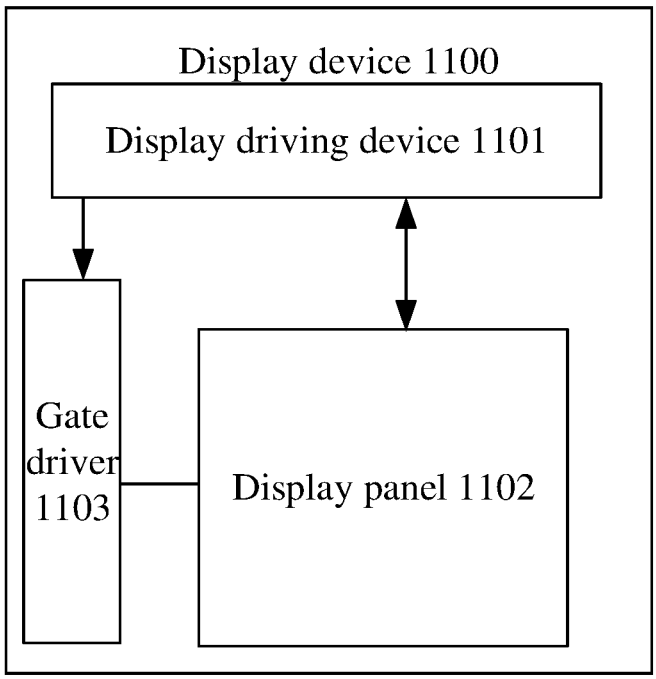
FIG. 11 is a schematic structural diagram of a display device according to another embodiment of the present disclosure.

FIG. 11 is a schematic diagram of a display device provided by another embodiment of the present disclosure. The display device 1100 includes a display driving device 1101, a display panel 1102, and a gate driver 1103.

For example, the display panel 1102 is configured to display images. After the image data to be displayed are input to the display device 1100, the input display signals are compensated for by the display drive device 1101. Then the display panel 1102 uses the compensated image data to display images, thereby improving the display effect of the display panel, improving the display quality, and improving the display uniformity. For example, the display panel 1102 may be an organic light emitting diode display panel.

For example, the display panel 1102 includes a plurality of pixel units arranged in an array. Each pixel unit includes, for example, a driving circuit and a light emitting element shown in FIG. 1. The driving circuit includes at least a driving transistor N0 and a switching transistor T0.

For example, the gate driver 1103 is configured to be connected to the switching transistors T0 through a plurality of gate lines for providing gate scanning signals to the switching transistors T0 to control the switching transistors T0 to be turned on or off.

For example, the display panel of the present embodiment may be an OLED display panel. Other types of displays may also be adopted, such as a quantum dot light emitting diode (QLED) display panel, a liquid crystal display panel, an electronic paper display panel, etc.

For example, the display device of the embodiments of the present disclosure may be applicable to different fields. In the commercial field, the display device may be applied to POS machines, ATM machines, copiers, game machines, etc. In the communication field, the display device may be applied to mobile phones, mobile network terminals, etc. In the computer field, the display device may be applied to PDAs (Personal Digital Assistant), commercial PC (personal computer), home PCs, notebook computers, etc. In the field of consumer electronic products, the display device may be applied to audio equipment, portable DVDs (Digital Video Disc), etc. In the industrial application field, the display device may be applied to instruments and meters. In the field of transportation, the display device may be applied to GPS (Global Positioning System), aircraft instruments, etc.

At least one embodiment of the present disclosure also provides a storage medium for storing computer-executable instructions. When executed by a computer, the computer-executable instructions may be configured to perform the compensation data compression method of the display panel provided by any embodiment of the present disclosure. The computer-executable instructions may be also configured to perform the compensation data decompression method of the display panel provided by any embodiment of the present disclosure. And the computer-executable instructions may be configured to perform the display driving method of the display panel provided by any embodiment of the present disclosure.

For example, the storage medium may be any combination of one or more computer-readable storage mediums. For example, one computer-readable storage medium contains computer-readable program codes for dividing display panel regions and determining a reference value based on a first compensation data of each pixel unit in each region. And another computer-readable storage medium contains computer-readable program codes for performing a computation on the first compensation data and the reference value to obtain second compensation data. For example, when the program code is read by a computer, the computer may execute the program codes stored in the computer storage medium to perform, for example, a compensation data compression method of a display panel provided by any embodiment of the present disclosure.

For example, the storage medium may include a memory card of a smartphone, a storage component of a tablet computer, a hard disk of a personal computer, a random access memory (RAM), a read-only memory (ROM), an erasable programmable read-only memory (EPROM), a portable compact disk read-only memory (CD-ROM), a flash memory, or any combination of the above storage media, or other suitable storage media.

The foregoing merely are exemplary embodiments of the present disclosure, and not intended to define the scope of the present disclosure, and the scope of the present disclosure is determined by the appended claims.

What is claimed is:

1. A compensation data compression method of a display panel, comprising:

dividing the display panel into at least one region;

determining a reference value according to first compensation data of each pixel unit in each of the at least one region; and performing a computation on the first compensation data and the reference value to obtain corresponding second compensation data, wherein a storage bit length of the second compensation data is shorter than a storage bit length of the first compensation data; and the dividing of the display panel into the at least one region comprises:

dividing the display panel into a plurality of regions, obtaining reference values of two adjacent regions respectively, subsequent to dividing the display panel into the plurality of regions; and merging the two adjacent regions into one region, in a case where a difference value between the two reference values is within a preset threshold range.

2. The compensation data compression method according to claim 1, wherein the first compensation data comprises electrical compensation data or optical compensation data of each pixel unit.

3. The compensation data compression method according to claim 2, wherein the determining the reference value according to the first compensation data of each pixel unit comprises:

obtaining any one of a maximum value, a minimum value, an average value, a maximum integer not greater than the average value, a median value, and a maximum integer not greater than the median value of all values of the first compensation data of all pixel units in each of the at least one region, as the reference value.

4. The compensation data compression method according to claim 2, wherein the performing the computation on the first compensation data and the reference value to obtain the corresponding second compensation data comprises:

subtracting the reference value from the first compensation data respectively to obtain the corresponding second compensation data.

5. The compensation data compression method according to claim 1, wherein the determining the reference value according to the first compensation data of each pixel unit comprises:

obtaining any one of a maximum value, a minimum value, an average value, a maximum integer not greater than the average value, a median value, and a maximum integer not greater than the median value of all values of the first compensation data of all pixel units in each of the at least one region, as the reference value.

6. The compensation data compression method according to claim 5, wherein the performing the computation on the first compensation data and the reference value to obtain the corresponding second compensation data comprises:

subtracting the reference value from the first compensation data respectively to obtain the corresponding second compensation data.

7. The compensation data compression method according to claim 1, wherein the performing the computation on the first compensation data and the reference value to obtain the corresponding second compensation data comprises:

subtracting the reference value from the first compensation data respectively to obtain the corresponding second compensation data.

8. The compensation data compression method according to claim 1, wherein for each of the at least one region, the first compensation data is presented in a matrix form, and a position of each element in a matrix of the first compensation data is in one-to-one correspondence to a position of each pixel unit in the region.

9. The compensation data compression method according to claim 1, wherein subsequent to obtaining the corresponding second compensation data, the compensation data compression method further comprises:

storing the reference value and the second compensation data.

10. The compensation data compression method according to claim 1, wherein the plurality of regions are arranged in rows and columns in the display panel.

11. A compensation data processing device of the display panel, the compensation data processing device comprising:

a processor; and a memory storing computer-executable instructions, wherein when the computer-executable instructions are executed by the processor, the compensation data compression method of the display panel according to claim 1 is performed.

12. A storage medium, configured to store computer-executable instructions, wherein when the computer-executable instructions are executed by a computer, the compensation data compression method of the display panel according to claim 1 is performed.

13. A compensation data decompression method of a display panel, the display panel being divided into at least one region, each region comprising a plurality of pixel units, for each of the plurality of pixel units, the method comprising:

obtaining initial compensation data of the pixel unit, wherein the initial compensation data comprises a reference value corresponding to a region where the pixel unit is located and second compensation data corresponding to the pixel unit;

performing a computation on the reference value and the second compensation data to obtain first compensation data corresponding to the pixel unit, wherein a storage bit length of the second compensation data is shorter than a storage bit length of the first compensation data; and using the first compensation data as decompressed compensation data of the pixel unit;

wherein the dividing of the display panel into the at least one region comprises:

dividing the display panel into a plurality of regions, obtaining reference values of two adjacent regions respectively, subsequent to dividing the display panel into the plurality of regions; and merging the two adjacent regions into one region, in a case where a difference value between the two reference values is within a preset threshold range.

14. The compensation data decompression method according to claim 13, wherein the method is sequentially performed for each of the at least one region.

15. A display driving method of a display panel, the display panel being divided into at least one region, each region comprising a plurality of pixel units, for each of the plurality of pixel units, the method comprising:

obtaining display data of the pixel unit;

obtaining decompressed compensation data of the pixel unit;

compensating for the display data by using the decompressed compensation data; and using the compensated display data for display, wherein the obtaining the decompressed compensation data of the pixel unit comprises:

performing the compensation data decompression method according to claim 13 to obtain the decompressed compensation data of the pixel unit.

16. The display driving method according to claim 15, wherein the method is sequentially performed for each of the at least one region.

17. A display driving device of the display panel, the display driving device comprising:

a processor; and a memory storing computer-executable instructions, wherein when the computer-executable instructions are executed by the processor, the display driving method of the display panel according to claim 15 is performed.

18. A display device comprising:

the display panel; and the display driving device of the display panel according to claim 17.

19. A compensation data compression device of a display panel, the compensation data compression device comprising:

a dividing circuit, configured to divide the display panel into at least one region;

a determination circuit, configured to determine a reference value according to first compensation data of each pixel unit in each of the at least one region; and a computation circuit, configured to perform a computation on the first compensation data and the reference value to obtain second compensation data, wherein a storage bit length of the second compensation data is shorter than a storage bit length of the first compensation data;

wherein the dividing of the display panel into the plurality of regions comprises:

dividing the display panel into a plurality of regions, obtaining reference values of two adjacent regions respectively, subsequent to dividing the display panel into the plurality of regions; and merging the two adjacent regions into one region, in a case where a difference value between the two reference values is within a preset threshold range.

* * * * *